US008596976B2

(12) United States Patent
Hada et al.

(10) Patent No.: US 8,596,976 B2
(45) Date of Patent: Dec. 3, 2013

(54) TURBINE BLADE

(75) Inventors: Satoshi Hada, Hyogo (JP); Tomoko Hashimoto, Hyogo (JP); Masanori Yuri, Hyogo (JP); Masamitsu Kuwabara, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 343 days.

(21) Appl. No.: 12/999,371

(22) PCT Filed: Nov. 7, 2008

(86) PCT No.: PCT/JP2008/070271
§ 371 (c)(1),
(2), (4) Date: Dec. 16, 2010

(87) PCT Pub. No.: WO2010/052784
PCT Pub. Date: May 14, 2010

(65) Prior Publication Data
US 2011/0103971 A1 May 5, 2011

(51) Int. Cl.
*F01D 5/08* (2006.01)

(52) U.S. Cl.
USPC ..... 416/96 A; 416/96 R; 416/95; 415/115

(58) Field of Classification Search
USPC ..... 416/96 R, 96 A, 97 A
See application file for complete search history.

(56) References Cited

U.S. PATENT DOCUMENTS

| | | | | | |
|---|---|---|---|---|---|
| 4,056,332 | A | * | 11/1977 | Meloni | 416/97 A |
| 4,063,851 | A | * | 12/1977 | Weldon | 416/97 A |
| 4,252,501 | A | | 2/1981 | Peill | |
| 4,413,949 | A | * | 11/1983 | Scott | 416/96 A |
| 5,660,524 | A | * | 8/1997 | Lee et al. | 416/97 R |
| 5,762,471 | A | * | 6/1998 | Cunha | 415/115 |
| 6,183,198 | B1 | | 2/2001 | Manning et al. | |
| 7,497,665 | B2 | * | 3/2009 | King et al. | 416/223 A |
| 2001/0051095 | A1 | | 12/2001 | Schotsch et al. | |

FOREIGN PATENT DOCUMENTS

| | | | |
|---|---|---|---|
| CN | 85107949 | A | 4/1986 |
| JP | 57035602 | Y2 | 8/1982 |
| JP | 59113204 | A | 6/1984 |
| JP | 1083825 | A | 3/1989 |
| JP | 3-253701 | A | 11/1991 |
| JP | 4-123301 | U | 11/1992 |
| JP | 9-280004 | A | 10/1997 |

(Continued)

OTHER PUBLICATIONS

International Search Report of corresponding application No. PCT/JP2008/070271 mailed Dec. 9, 2008.

(Continued)

*Primary Examiner* — Nathaniel Wiehe
*Assistant Examiner* — Eldon Brockman
(74) *Attorney, Agent, or Firm* — Kanesaka Berner & Partners, LLP

(57) ABSTRACT

The amount of cooling air (cooling medium) can be reduced, and low-temperature cooling air is prevented from being blown out through film cooling holes. Part of a cooling medium impingement-cooling an inner circumferential surface of a blade main body located on a ventral side further impingement-cools the inner circumferential surface of the blade main body located on a dorsal side and is blown out through film cooling holes in the blade main body that are located on the dorsal side.

21 Claims, 3 Drawing Sheets

(56) References Cited

FOREIGN PATENT DOCUMENTS

| | | | |
|---|---|---|---|
| JP | 10-266805 | A | 10/1998 |
| JP | 11-257003 | A | 9/1999 |
| JP | 2000161004 | A | 6/2000 |
| JP | 2001098905 | A | 4/2001 |
| JP | 2001-140602 | A | 5/2001 |
| JP | 2001-214706 | A | 8/2001 |
| JP | 2008-274906 | A | 11/2008 |

OTHER PUBLICATIONS

European Search Report for EP 08877979, dated Feb. 29, 2012.
Japanese Notice of Allowance for JP2007122351, mailed May 29, 2012.
Japanese Office Action for JP2007-122351, mailed Aug. 30, 2011.
Search Report as issued on Mar. 19, 2013, for corresponding Chinese Patent Application No. 2008801299189.
Decision to Grant as issued on Aug. 26, 2013 in corresponding Korean Patent Application No. 2010-7028198.

* cited by examiner

TURBINE BLADE

RELATED APPLICATIONS

The present application is based on, and claims priority from, International Application Number PCT/JP2008/070271, filed Nov. 7, 2008, the disclosure of which is hereby incorporated by reference herein in its entirety.

TECHNICAL FIELD

The present invention relates to a gas turbine and, more specifically, to a turbine blade (rotor blade, stator blade) of the gas turbine.

BACKGROUND ART

A known example of a turbine blade (for example, a second-stage stator blade) in a turbine section of a gas turbine is disclosed in Patent Citation 1, for example.

Patent Citation 1:

Japanese Unexamined Patent Application, Publication No. Hei-3-253701

DISCLOSURE OF INVENTION

However, in a turbine blade disclosed in Patent Citation 1, in order to efficiently cool the inner wall surface (inner circumferential surface) of a blade main body, it is necessary to dispose the wall surface of an insert such that impingement holes therein are located as close as possible to the inner wall surface of the blade main body. Therefore, there is a problem in that a flow passage cross-sectional area of the insert is inevitably increased, thus increasing the amount of cooling air and decreasing the performance of the gas turbine.

Further, cooling air introduced to the inside of the insert passes through a plurality of impingement holes formed in the insert to impingement-cool the inner wall of the blade main body and is then blown out through a plurality of film cooling holes formed in the blade main body. Specifically, all of the cooling air introduced to the inside of the insert performs impingement-cooling only once and flows out to the outside of the blade main body through the film cooling holes. Therefore, there is a risk that low-temperature cooling air is blown out through the film cooling holes, thus reducing the gas temperature in the gas turbine and reducing the heat efficiency of the gas turbine.

The present invention has been made in view of the above-described circumstances, and an object thereof is to provide a turbine blade capable of reducing the amount of cooling air (cooling medium) and of preventing low-temperature cooling air from being blown out through film cooling holes.

In order to solve the above-described problems, the present invention employs the following solutions.

According to the present invention, there is provided a turbine blade including: a blade main body that is provided with a plurality of film cooling holes and inside which at least two cavities are formed by at least one plate-like rib provided substantially orthogonal to a center line connecting a leading edge and a trailing edge, in a cross-sectional plane substantially orthogonal to an upright-direction axis; and a hollow insert that is disposed in each of the cavities so as to form a cooling space between an outer circumferential surface of the insert and an inner circumferential surface of the blade main body and that is provided with a plurality of impingement cooling holes, in which part of a cooling medium that has impingement-cooled a ventral side of the inner circumferential surface of the blade main body further impingement-cools a dorsal side of the inner circumferential surface of the blade main body and is then blown out through dorsal-side film cooling holes of the film cooling holes in the blade main body.

According to the turbine blade of the present invention, the flow passage cross-sectional areas of the inserts in the cavities are reduced; thus, the total amount of cooling air (cooling air consumption) can be reduced.

Further, part of cooling air introduced to the inside of an insert is introduced to the inside of another insert and is used to impingement-cool the inner wall surface of the blade main body on the dorsal side and to film-cool the outer wall surface (outer circumferential surface) of the blade main body on the dorsal side.

Thus, it is possible to reduce or minimize the amount of cooling air introduced to the insides of the inserts, to further reduce the total amount of cooling air (by approximately 10 percent, compared with a conventional technology), and to prevent low-temperature cooling air from being blown out through the film cooling holes.

According to the present invention, there is provided a turbine blade including: a blade main body that is provided with a plurality of film cooling holes and inside which at least two cavities are formed by at least one plate-like rib provided substantially orthogonal to a center line connecting a leading edge and a trailing edge, in a cross-sectional plane substantially orthogonal to an upright-direction axis; and hollow inserts that are disposed in each of the cavities so as to form a cooling space between outer circumferential surfaces of the inserts and an inner circumferential surface of the blade main body and that are provided with a plurality of impingement cooling holes, in which the inserts are disposed, one each, on a ventral side and a dorsal side in the cavity; and part of a cooling medium blown out toward the ventral side of the inner circumferential surface of the blade main body through the impingement cooling holes in the insert that is disposed on the ventral side passes through the cooling space, is initially introduced to the inside of the insert that is disposed on the dorsal side, and is then blown out toward the dorsal side of the inner circumferential surface of the blade main body through the impingement cooling holes in the insert that is disposed on the dorsal side.

According to the turbine blade of the present invention, the flow passage cross-sectional areas of the inserts in the cavities are reduced, as shown in FIG. 2, for example; thus, the total amount of cooling air (cooling air consumption) can be reduced.

Further, part of cooling air introduced to the inside of an insert is introduced to the inside of another insert and is used to impingement-cool the inner wall surface of the blade main body on the dorsal side and to film-cool the outer wall surface (outer circumferential surface) of the blade main body on the dorsal side.

Thus, it is possible to reduce or minimize the amount of cooling air introduced to the insides of the inserts, to further reduce the total amount of cooling air (by approximately 10 percent, compared with a conventional technology), and to prevent low-temperature cooling air from being blown out through the film cooling holes.

According to the present invention, there is provided a turbine blade including: a blade main body that is provided with a plurality of film cooling holes and inside which at least two cavities are formed by at least one plate-like rib provided substantially orthogonal to a center line connecting a leading edge and a trailing edge, in a cross-sectional plane substantially orthogonal to an upright-direction axis; and a hollow insert that is disposed in each of the cavities so as to form a cooling space between an outer circumferential surface of the insert and an inner circumferential surface of the blade main body and that is provided with a plurality of impingement cooling holes, in which an impingement plate that splits the cooling space formed between the outer circumferential surface located on a dorsal side in the cavity and the dorsal side of the inner circumferential surface of the blade main body into two spaces along the outer circumferential surface located on the dorsal side in the cavity and the dorsal side of the inner circumferential surface of the blade main body and that is provided with a plurality of impingement cooling holes is provided on the dorsal side in the cavity.

According to the turbine blade of the present invention, the flow passage cross-sectional areas of the inserts in the cavities are reduced, as shown in FIG. 3, for example; thus, the total amount of cooling air (cooling air consumption) can be reduced.

Further, part of cooling air introduced to the inside of an insert is blown out to the cooling space through the impingement cooling holes formed in the impingement plate and is used to impingement-cool the inner wall surface of the blade main body on the dorsal side and to film-cool the outer wall surface (outer circumferential surface) of the blade main body on the dorsal side; thus, it is possible to prevent low-temperature cooling air from being blown out through the film cooling holes.

A gas turbine according to the present invention includes a turbine blade capable of reducing the total amount of cooling air and of preventing low-temperature cooling air from being blown out through the film cooling holes.

According to the gas turbine of the present invention, the total amount of cooling air is reduced, thereby improving the performance of the gas turbine; and low-temperature cooling air is prevented from being blown out through the film cooling holes, thereby improving the heat efficiency of the gas turbine.

According to the present invention, an advantage is afforded in that it is possible to reduce the amount of cooling air (cooling medium) and to prevent low-temperature cooling air from being blown out through the film cooling holes.

EXPLANATION OF REFERENCE

Figure 1:
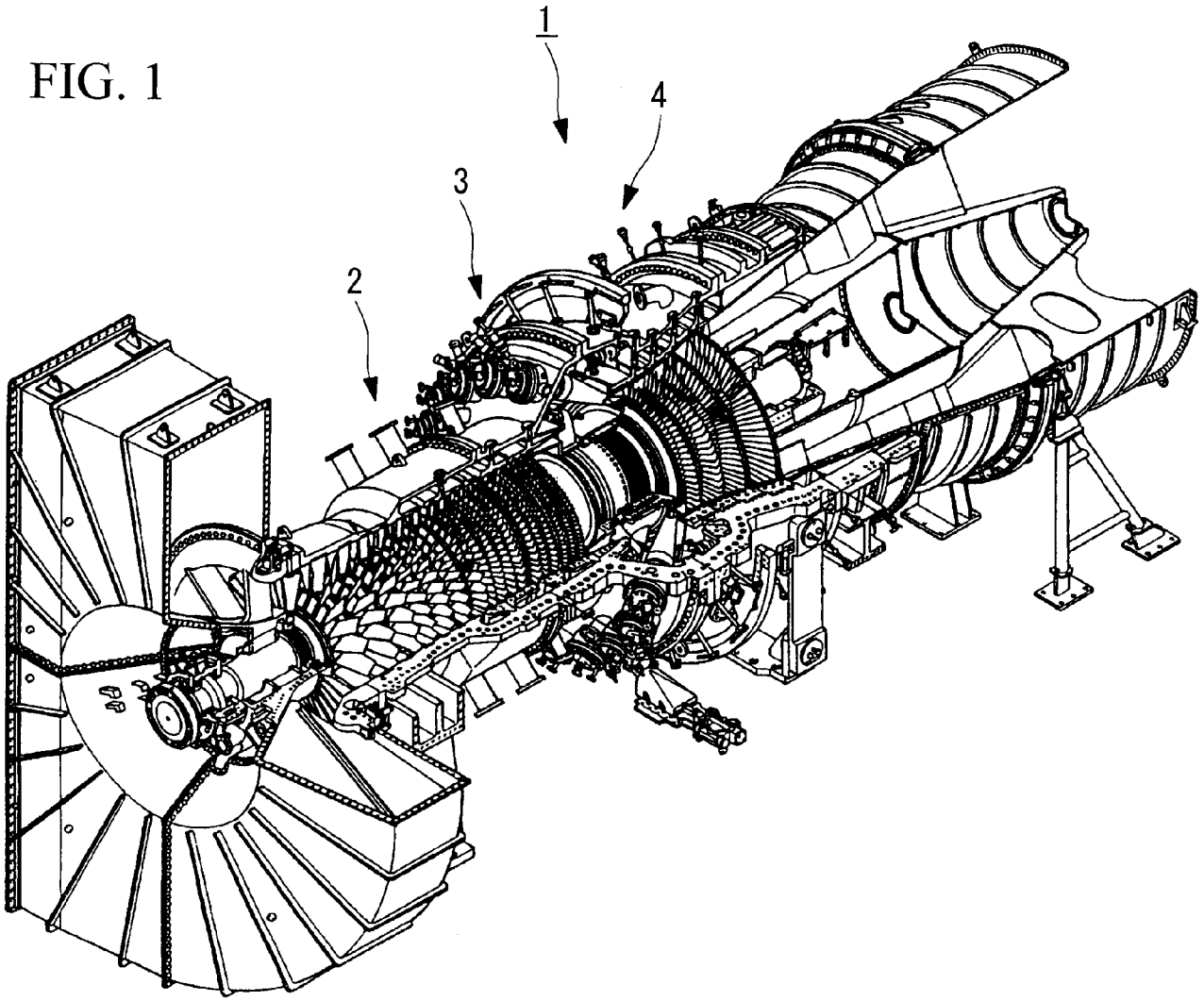
FIG. 1 is a view showing a gas turbine having a turbine blade according to the present invention and is a perspective view showing, in outline, a state where the upper half of a cylinder is removed.

1: gas turbine
10: turbine blade
11: blade main body
12*a:* insert
12*b:* insert
12*c:* insert
13: film cooling hole
14: rib
15: impingement cooling hole
16: outer wall surface (outer circumferential surface)
17: inner wall surface (inner circumferential surface)
20: turbine blade
21: insert
22: impingement plate
24: outer wall surface (outer circumferential surface)
C1: cavity
C2: cavity
L.E.: leading edge

BEST MODE FOR CARRYING OUT THE INVENTION

A turbine blade according to one embodiment of the present invention will be described below with reference to FIGS. 1 and 2.

FIG. 1 is a view showing a gas turbine 1 having a turbine blade 10 according to the present invention and is a perspective view showing, in outline, a state where the upper half of a cylinder is removed. FIG. 2 is a main-portion sectional view of an approximately center portion of the turbine blade 10 according to this embodiment, in a plane substantially orthogonal to an upright-direction axis.

As shown in FIG. 1, the gas turbine 1 includes, as main components, a compression section 2 that compresses combustion air, a combustion section 3 that injects fuel into high-pressure air sent from the compression section 2 to combust it to produce high-temperature combustion gas, and a turbine section 4 that is located at a downstream side of the combustion section 3 and is driven by the combustion gas output from the combustion section 3.

Figure 2:
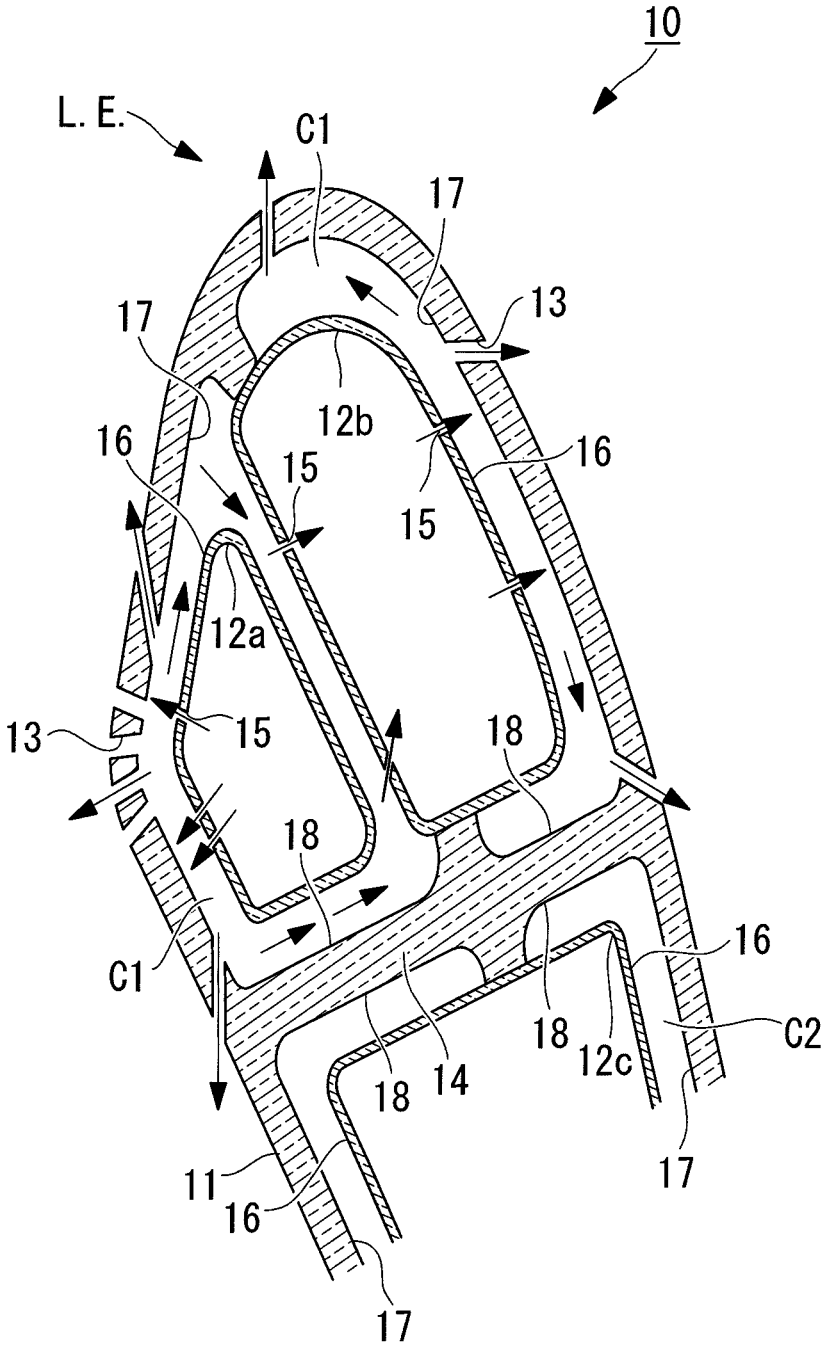
FIG. 2 is a main-portion sectional view of an approximately center portion of a turbine blade according to one embodiment of the present invention, in a plane substantially orthogonal to an upright-direction axis.

As shown in FIG. 2, the turbine blade 10 of this embodiment can be used as a second-stage stator blade in the turbine section 4, for example, and includes a blade main body 11 and a plurality of inserts 12*a*, 12*b*, 12*c*, . . . .

The blade main body 11 is provided with a plurality of film cooling holes 13; a plate-like rib 14 that is provided substantially orthogonal to a center line (not shown) connecting a leading edge LE and a trailing edge (not shown), in a cross-sectional plane substantially orthogonal to the upright-direction axis of the blade main body 11 and that partitions the inside of the blade main body 11 into a plurality of cavities C1, C2, . . . ; and an air hole (not shown) that guides cooling air (cooling medium) in the cavity located closest to the trailing edge to the outside of the blade main body 11 and that has a plurality of pin-fins (not shown).

Each of the inserts 12*a*, 12*b*, and 12*c* is a hollow member having a plurality of impingement cooling holes 15 provided therein. Two inserts 12*a* and 12*b* are provided in the cavity C1 that is located closest to the leading edge, and one insert 12*c* is provided in the other cavity C2.

The insert 12*a* is disposed at a ventral side in the cavity C1, and the insert 12*b* is disposed at a dorsal side in the cavity C1. A cooling space, that is, a cooling air passage, is formed between outer circumferential surfaces 16 of the inserts 12*a* and 12*b* and an inner wall surface (inner circumferential surface) 17 of the blade main body 11, between the outer circumferential surfaces 16 of the inserts 12*a* and 12*b* and a wall surface 18 of the rib 14, and between the outer circumferential surface 16 of the insert 12*a* and the outer circumferential surface 16 of the insert 12*b*.

On the other hand, a cooling space, that is, a cooling air passage, is also formed between the outer circumferential surface 16 of the insert 12*c* disposed in the cavity C2 and the inner wall surface 17 of the blade main body 11 and between the outer circumferential surface 16 of the insert 12*c* and the wall surface 18 of the rib 14.

In the thus-structured turbine blade 10, cooling air is introduced to the insides of the inserts 12*a*, 12*b*, and 12*c* by some means (not shown) and is blown out to the cooling space through the plurality of impingement cooling holes 15, thereby impingement-cooling the inner wall surface 17 of the blade main body 11.

The cooling air impingement-cooling the inner wall surface 17 of the blade main body 11 is blown out through the plurality of film cooling holes 13 in the blade main body 11 to form a film layer of the cooling air around the blade main body 11, thereby film-cooling the blade main body 11.

Further, from the trailing edge of the blade main body 11, the cooling air is blown out through the air hole (not shown) to cool the pin-fins (not shown), thereby cooling the vicinity of the trailing edge of the blade main body 11.

Furthermore, as indicated by solid arrows in FIG. 2, in the turbine blade 10 of this embodiment, part of cooling air that is introduced to the inside of the insert 12*a* and that is blown out to the cooling space through the impingement cooling holes 15 that are provided facing the inner wall surface 17 of the blade main body 11 on the ventral side to impingement-cool the inner wall surface 17 of the blade main body 11 on the ventral side passes through the cooling space formed between the outer circumferential surface 16 of the insert 12*a* and the inner wall surface 17 of the blade main body 11 and flows into the cooling space formed between the outer circumferential surface 16 of the insert 12*a* and the outer circumferential surface 16 of the insert 12*b*. Then, the cooling air flowing into the cooling space formed between the outer circumferential surface 16 of the insert 12*a* and the outer circumferential surface 16 of the insert 12*b* flows into the inside of the insert 12*b* through the impingement cooling holes 15 that are provided facing the insert 12*a* (more specifically, facing the wall surface of the insert 12*a* located on the dorsal side), is blown out to the cooling space through the impingement cooling holes 15 that are provided facing the inner wall surface 17 of the blade main body 11 on the dorsal side to impingement-cool the inner wall surface 17 of the blade main body 11 on the dorsal side, together with the cooling air introduced to the inside of the insert 12*b* by some means (not shown), and is then blown out through the film cooling holes 13.

According to the turbine blade 10 of this embodiment, the flow passage cross-sectional areas of the inserts 12*a* and 12*b* in the cavity C1 are reduced, thereby reducing the total amount of cooling air (cooling air consumption).

Further, part of the cooling air introduced to the inside of the insert 12*a* is introduced to the inside of the insert 12*b* and is used to impingement-cool the inner wall surface 17 of the blade main body 11 on the dorsal side and to film-cool the outer wall surface (outer circumferential surface) of the blade main body 11 on the dorsal side.

Thus, it is possible to reduce or minimize the amount of cooling air introduced to the inside of the insert 12*b*, to further reduce the total amount of cooling air (by approximately 10 percent, compared with a conventional technology), and to prevent low-temperature cooling air from being blown out through the film cooling holes 13.

According to the gas turbine 1 having the turbine blade 10 of this embodiment, the total amount of cooling air is reduced, thereby improving the performance of the gas turbine; and low-temperature cooling air is prevented from being blown out through the film cooling holes 13, thereby improving the heat efficiency of the gas turbine.

A turbine blade according to another embodiment of the present invention will be described with reference to FIG. 3.

Figure 3:
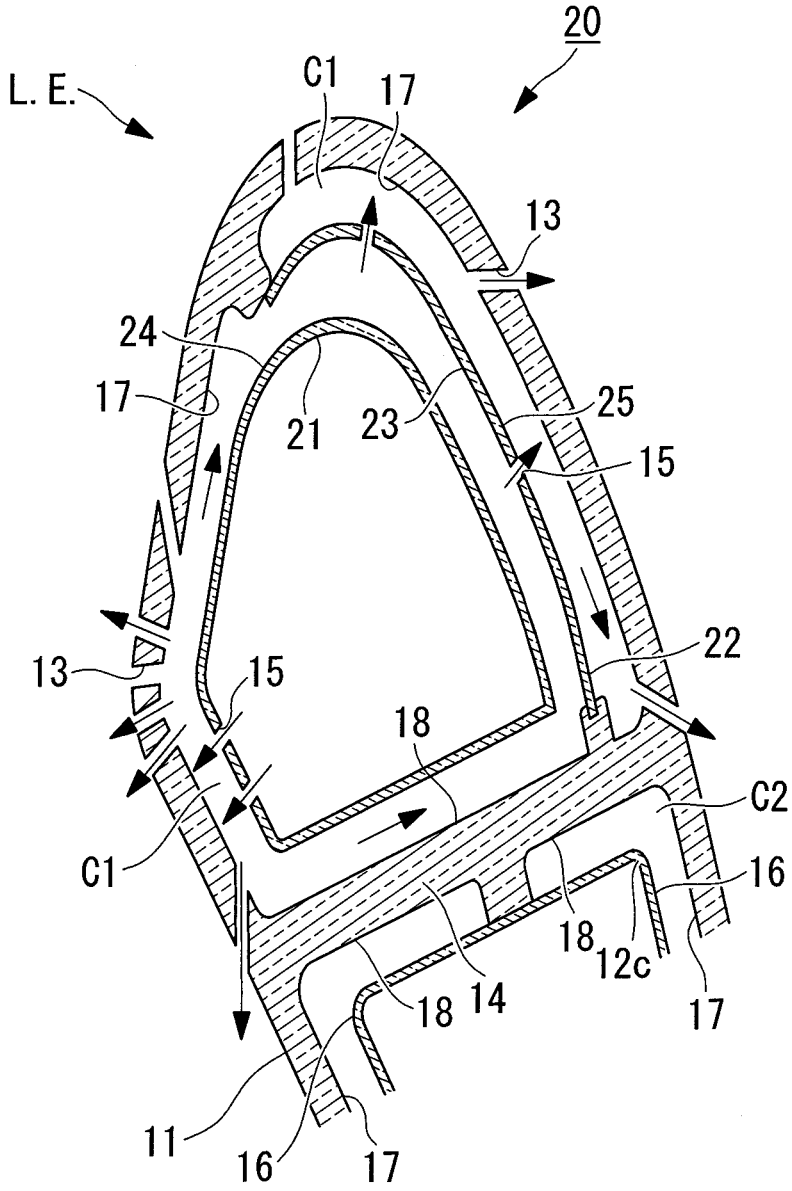
FIG. 3 is a main-portion sectional view of an approximately center portion of a turbine blade according to another embodiment of the present invention, in a plane substantially orthogonal to an upright-direction axis.

FIG. 3 is a main-portion sectional view of an approximately center portion of a turbine blade 20 according to this embodiment in a plane substantially orthogonal to an upright-direction axis.

The turbine blade 20 of this embodiment differs from that of the above-described first embodiment in that an insert 21 is provided instead of the insert 12*a*, and an impingement plate 22 is provided instead of the insert 12*b*. Since the other components are the same as those in the above-described first embodiment, a description of the components will be omitted here.

The insert 21 is a hollow member having a plurality of impingement cooling holes 15 provided therein, and the impingement plate 22 is a plate-like member having a plurality of impingement cooling holes 15 provided therein. The insert 21 and the impingement plate 22 are contained (accommodated) in the cavity C1, which is located closest to the leading edge.

The impingement plate 22 is disposed such that an inner wall surface (inner circumferential surface) 23 thereof faces an outer wall surface (outer circumferential surface) 24 of the insert 21 located on the dorsal side, and an outer wall surface (outer circumferential surface) 25 thereof faces the inner wall surface 17 of the blade main body 11 located on the dorsal side.

Then, a cooling space, that is, a cooling air passage, is formed between the outer wall surface 24 of the insert 21 and the inner wall surface 17 of the blade main body 11 located on the ventral side, between the outer wall surface 24 of the insert 21 and the wall surface 18 of the rib 14, between the outer wall surface 24 of the insert 21 and the inner wall surface 23 of the impingement plate 22, and between the outer wall surface 25 of the impingement plate 22 and the inner circumferential surface 17 of the blade main body 11 located on the dorsal side.

In the thus-structured turbine blade 20, cooling air is introduced to the insides of the inserts 21 and 12*c* by some means (not shown) and is blown out to the cooling space through the plurality of impingement cooling holes 15, thereby impingement-cooling the inner wall surface 17 of the blade main body 11.

The cooling air impingement-cooling the inner wall surface 17 of the blade main body 11 is blown out through the plurality of film cooling holes 13 in the blade main body 11 to form a film layer of the cooling air around the blade main body 11, thereby film-cooling the blade main body 11.

Further, from the trailing edge of the blade main body 11, the cooling air is blown out through the air hole (not shown) to cool the pin-fins (not shown), thereby cooling the vicinity of the trailing edge of the blade main body 11.

Furthermore, as indicated by solid arrows in FIG. 3, in the turbine blade 20 of this embodiment, part of cooling air that is introduced to the inside of the insert 21 and that is blown out to the cooling space through the impingement cooling holes 15 that are provided facing the inner wall surface 17 of the blade main body 11 on the ventral side to impingement-cool the inner wall surface 17 of the blade main body 11 on the ventral side passes through the cooling space formed between the outer wall surface 24 of the insert 21 and the inner wall surface 17 of the blade main body 11 and the cooling space formed between the outer wall surface 24 of the insert 21 and the wall surface 18 of the rib 14 and flows into the cooling space formed between the outer wall surface 24 of the insert 21 and the inner wall surface 23 of the impingement plate 22. Then, the cooling air flowing into the cooling space formed between the outer wall surface 24 of the insert 21 and the inner wall surface 23 of the impingement plate 22 is blown out to the cooling space through the impingement cooling holes 15 that are provided facing the inner wall surface 17 of the blade main body 11 on the dorsal side to impingement-cool the inner wall surface 17 of the blade main body 11 on the dorsal side, and is then blown out through the film cooling holes 13.

According to the turbine blade 20 of this embodiment, the flow passage cross-sectional area of the insert 21 in the cavity C1 is reduced, thereby reducing the total amount of cooling air (cooling air consumption).

Further, part of cooling air introduced to the inside of the insert 21 is blown out to the cooling space through the impingement cooling holes 15 formed in the impingement plate 22 and is used to impingement-cool the inner wall surface 17 of the blade main body 11 on the dorsal side and to film-cool the outer wall surface (outer circumferential surface) of the blade main body 11 on the dorsal side; thus, it is possible to prevent low-temperature cooling air from being blown out through the film cooling holes 13.

Furthermore, according to the gas turbine 1 having the turbine blade 20 of this embodiment, the total amount of cooling air is reduced, thereby improving the performance of the gas turbine; and low-temperature cooling air is prevented from being blown out through the film cooling holes 13, thereby improving the heat efficiency of the gas turbine.

Note that the present invention can be used not only as the second-stage stator blade, but also as a different-stage stator blade or rotor blade.

Further, the present invention can be applied not only to the inside of the cavity C1 located closest to the leading edge, but also to the inside of the other cavity C2.

The invention claimed is:

1. A turbine blade comprising:

a blade main body that is provided with a plurality of film cooling holes and inside which at least two cavities are independently formed with respect to each other by at least one plate rib provided substantially orthogonal to a center line connecting a leading edge and a trailing edge, in a cross-sectional plane substantially orthogonal to a direction of an axis along which a span of the turbine blade extends; and a hollow insert that is disposed in the cavities of the at least two cavities so as to form a cooling space between an outer circumferential surface of the hollow insert and an inner circumferential surface of the blade main body and that is provided with a plurality of impingement cooling holes, wherein, in at least one of the at least two cavities that are independently formed with respect to each other, part of a cooling medium that has impingement-cooled a ventral side of the inner circumferential surface of the blade main body further impingement-cools a dorsal side of the inner circumferential surface of the blade main body and is then blown out through dorsal-side film cooling holes of the plurality of film cooling holes in the blade main body.

2. A gas turbine comprising the turbine blade according to claim 1.

3. The gas turbine of claim 2, wherein:

the gas turbine is configured such that cooling medium is forced out a hole through the main body from inside the mail body to outside the main body, wherein the hole is located at least about at the leading edge of the turbine blade.

4. The turbine blade according to claim 1, wherein:

the blade main body is configured such that the cavities of the at least two cavities are fludically isolated from one another with respct to fluid flow within the blade main body.

5. The turbine blade according to claim 1, wherein:

the blade main body is configured such that the cavities of the at least two cavities are fludically isolated from one another by the plate rib with respect to fluid flow within the blade main body.

6. The turbine blade according to claim 1, wherein:

the turbine blade is configured such that the part of the cooling medium that has impingement-cooled a ventral side of the inner circumferential surface of the blade main body further impingement-cools a dorsal side of the inner circumferential surface of the blade main body on a leading edge side of the turbine blace prior to impingement cooling a portion of the turbine blade on an trailing edge side of the plate rib.

7. A turbine blade comprising:

a blade main body that is provided with a plurality of film cooling holes and inside which at least two cavities are independently formed with respect to each other by at least one plate rib provided substantially orthogonal to a center line connecting a leading edge and a trailing edge, in a cross-sectional plane substantially orthogonal to a direction of an axis along which a span of the turbine blade extends; and hollow inserts that are disposed in the cavities of the at least two cavities so as to form a cooling space between outer circumferential surfaces of the hollow inserts and an inner circumferential surface of the blade main body and that are provided with a plurality of impingement cooling holes, wherein, in at least one of the at least two cavities that are independently formed with respect to each other, the hollow inserts are disposed, one each, on a ventral side and a dorsal side in one of the cavities of the at least two cavities; and part of a cooling medium blown out toward the ventral side of the inner circumferential surface of the blade main body through the impingement cooling holes of the plurality of impingement cooling holes in the hollow insert that is disposed on the ventral side passes through the cooling space, is initially introduced to the inside of the hollow insert that is disposed on the dorsal side, and is then blown out toward the dorsal side of the inner circumferential surface of the blade main body through the impingement cooling holes of the plurality of impingement cooling holes in the hollow insert that is disposed on the dorsal side.

8. A gas turbine comprising the turbine blade according to claim 7.

9. The gas turbine of claim 8, wherein:

the gas turbine is configured such that cooling medium is forced out a hole through the main body from inside the main body to outside the main body, wherein the hole is located at least about at the leading edge of the turbine blade.

10. The turbine blade according to claim 7, wherein, in one of the inserts disposed on the ventral side, the plurality of impingement cooling holes are formed only at a ventral side.

11. The turbine blade according to claim 7, wherein, in one of the inserts disposed on the ventral side, no impingement cooling holes are formed at a dorsal side.

12. The turbine blade according to claim 7, wherein:

the blade main body is configured such that the cavities of the at least two cavities are fludically isolated from one another with respect to fluid flow within the blade main body.

13. The turbine blade according to claim 7, wherein:

the blade main body is configured such that the cavities of the at least two cavities are fludically isolated from one another by the plate rib with respect to fluid flow within the blade main body.

14. The turbine blade according to claim 7, wherein:

the turbine blade is configured such that the part of the cooling medium that has impingement-cooled a ventral side of the inner circumferential surface of the blade main body further impingement-cools a dorsal side of the inner circumferential surface of the blade main body on a leading edge side of the turbine blade prior to impingement cooling a portion of the turbine blade on an trailing edge side of the plate rib.

15. A turbine blade comprising:

a blade main body that is provided with a plurality of film cooling holes and inside which at least two cavities are independently formed with respect to each other by at least one plate rib provided substantially orthogonal to a center line connecting a leading edge and a trailing edge, in a cross-sectional plane substantially orthogonal to a direction of an axis along which a span of the turbine blade extends; and a hollow insert that is disposed in the cavities of the at least two cavities so as to form a cooling space between an outer circumferential surface of the hollow insert and an inner circumferential surface of the blade main body and that is provided with a plurality of first impingement cooling holes, wherein an impingement plate that splits the cooling space formed between the circumferential surface of the hollow insert located on a dorsal side in at least one of the cavities of the at least two cavities that are independently formed with respect to each other and the dorsal side of the inner circumferential surface of the blade main body into two spaces along the outer circumferential surface of the hollow insert located on the dorsal side in the one of the cavities of the at least two cavities and the dorsal side of the inner circumferential surface of the blade main body and that is provided with a plurality of second impingement cooling holes is provided on the dorsal side in the at least one of the cavities of the at least two cavities.

16. A gas turbine comprising the turbine blade according to claim 15.

17. The gas turbine of claim 16, wherein:

the gas turbine is configured such that cooling medium is forced out a hole through the main body from inside the main body to outside the main body, wherein the hole is located at least about at the leading edge of the turbine blade.

18. The turbine blade according claim 15, wherein, in the insert, the plurality of impingement cooling holes are formed only at a ventral side.

19. The turbine blade according to claim 15, wherein, in the insert, no impingement cooling holes are formed at a dorsal side.

20. The turbine blade according to claim 15, wherein:

the blade main body is configured such that the cavities of the at least two cavities are fludically isolated from one another with respect to fluid flow within the blade main body.

21. The turbine blade according to claim 15, wherein:

the blade main body is configured such that the cavities of the at least two cavities are fludically isolated from one another by the plate to rib with respect to fluid flow within the blade main body.

* * * * *